US008607397B1

(12) United States Patent
Caver

(10) Patent No.: US 8,607,397 B1
(45) Date of Patent: Dec. 17, 2013

(54) BUCKET-MOUNTED CONCRETE TOOL-CLEANING DEVICE

(76) Inventor: Marcel Caver, Bedford Heights, OH (US)

( * ) Notice: Subject to any disclaimer, the term of this patent is extended or adjusted under 35 U.S.C. 154(b) by 228 days.

(21) Appl. No.: 13/300,773

(22) Filed: Nov. 21, 2011

(51) Int. Cl.
*A46B 15/00* (2006.01)
*A46B 9/00* (2006.01)

(52) U.S. Cl.
USPC ..... 15/160; 15/246; 15/104.92; 220/697; 220/736; 248/213.2; 248/230.1; 248/309.1

(58) Field of Classification Search
USPC ..... 15/160, 246, 220.4, 218, 218.1, 210.1; 248/213.2, 214, 220.21, 223.41, 224.7, 248/224.8, 223.21, 226.11, 230.1, 230.6, 248/309.1; 220/736, 735, 700, 699, 698, 220/697, 695
See application file for complete search history.

(56) References Cited

U.S. PATENT DOCUMENTS 414,527 A * 11/1889 Gwyn ..... 15/246
1,577,565 A * 3/1926 Creegan ..... 4/559
5,437,075 A * 8/1995 Peake ..... 15/161
5,652,993 A 8/1997 Kreyer
5,839,152 A 11/1998 Kruskamp
7,200,891 B1 4/2007 McCulloch et al.
2002/0152568 A1 10/2002 Dillinger

* cited by examiner

*Primary Examiner* — Mark Spisich
*Assistant Examiner* — Andrew A Horton
(74) *Attorney, Agent, or Firm* — Kyle Fletcher

(57) ABSTRACT

The bucket-mounted concrete tool-cleaning device includes a pair of snap-on cleaner heads that attach onto a cleaner head base. The cleaner head base attaches onto an inner, surface of a 5-gallon bucket and includes a plurality of adjustment slots located on an outer surface of the cleaner head base. The cleaner head base further includes a screw that tightens in order to secure the cleaner base onto the side of the 5-gallon bucket. The adjustment slots are for use in attaching one of the snap-on cleaner heads at varying heights within the 5-gallon bucket in order to adjust for varying water levels within said bucket. The snap-on cleaner heads feature a plurality of bristles that adorn an inner channel, which scrub a tool or float clean of concrete after use. The cleaner head base attaches at an angle to an interior surface of the 5-gallon bucket.

18 Claims, 5 Drawing Sheets

BUCKET-MOUNTED CONCRETE TOOL-CLEANING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of concrete tools and floats, more specifically, a bucket-mounted cleaning brush that is specifically suited for cleaning tools and floats used in forming concrete.

B. Discussion of the Prior Art

As will be discussed immediately below, no prior art discloses a concrete tool and float cleaning device that mounts onto a 5 gallon bucket and of which is slideably adjusted to provide varying heights for use with varying fluid levels within said bucket; wherein different snap-on cleaner heads are provided and encircle a tool or float to be cleaned; wherein each snap-on cleaner head features a plurality of bristles along an inner channel that scrub the tool or float clean of concrete after use of said tool or float.

The Kreyer Patent (U.S. Pat. No. 5,652,993) discloses a knife cleaner including a brush means which may be suspended within a container containing a solvent. The brush means may be a plate having a central aperture with a pair of brushes facing each other and extending from the sides of the aperture. The brushes may be selectively removed, and suspension may be accompanied with a plurality of hooks extending from the plate that can engage an open end of the container.

The Kruskamp Patent (U.S. Pat. No. 5,839,152) discloses an accessory for removing an adhesive from a trowel blade. The accessory includes a body having an elongated slot and means on the side of the slot for scraping adhesive from a trowel; the means can be two opposing scraping blades on either side of the slot; the accessory can also include means for mounting the body of an upper rim of a bucket; the slot can only accommodate one lateral edge of the blade at a time.

The Dillinger Patent Application Publication (U.S. Pub. No. 2002/0152568) discloses a system for cleaning the exterior and interior of drywall tools and includes a bucket, a metal frame that attaches to an upper rim of the bucket, a brush or brushes attached to the metal frame, and a pump assembly with a hose for attachment to an inlet port of a tool to be cleaned.

The McCulloch Patent (U.S. Pat. No. 7,200,891) discloses a cleaning assembly for substantially flat tools that includes a bucket-like container having a plurality of interior opposed and horizontally-oriented brushes that can be releasably attached to a mount assembly.

While the above-described devices fulfill their respective and particular objects and requirements, they do not describe a concrete tool and float cleaning device that mounts onto a 5-gallon bucket and of which is slideably adjusted to provide varying heights for use with varying fluid levels within said bucket; wherein different snap-on cleaner heads are provided and encircle a tool or float to be cleaned; wherein each snap-on cleaner head features a plurality of bristles along an inner channel that scrub the tool or float clean of concrete after use of said tool or float. In this regard, the bucket-mounted concrete tool-cleaning device departs from the conventional concepts and designs of the prior art.

SUMMARY OF THE INVENTION

The bucket-mounted concrete tool-cleaning device includes a pair of snap-on cleaner heads that attach onto a cleaner head base. The cleaner head base attaches onto an inner, surface of a 5-gallon bucket and includes a plurality of adjustment slots located on an outer surface of the cleaner head base. The cleaner head base further includes a screw that tightens in order to secure the cleaner base onto the side of the 5-gallon bucket. The adjustment slots are for use in attaching one of the snap-on cleaner heads at varying heights within the 5-gallon bucket in order to adjust for varying water levels within said bucket. The snap-on cleaner heads feature a plurality of bristles that adorn an inner channel, which scrub a tool or float clean of concrete after use. The cleaner head base attaches at an angle to an interior surface of the 5-gallon bucket.

An object of the invention is to provide a cleaning system for use in cleaning tools and floats customarily used in working with concrete.

A further object of the invention is to provide a cleaning system that attaches to an interior of a 5-gallon bucket.

An even further object of the invention is to provide a screw that tightens to secure the cleaner head base to the 5-gallon bucket in order to prevent de-attachment therefrom.

A further object of the invention is to provide a cleaner head base that forms an angle with respect to the 5-gallon bucket.

An even further object of the invention is to provide an angle that is acute with respect to the 5-gallon bucket.

A further object of the invention is to provide at least two different snap-on cleaner heads that have internal channels lined with a plurality of bristles that scrub off concrete from either a tool or float after use.

A further object of the invention is to provide a plurality of adjustment slots that enable the snap-on cleaner heads to attach at different elevations within the bucket in order to adjust to varying water levels.

These together with additional objects, features and advantages of the bucket-mounted concrete tool-cleaning device will be readily apparent to those of ordinary skill in the art upon reading the following detailed description of presently preferred, but nonetheless illustrative, embodiments of the bucket-mounted concrete tool-cleaning device when taken in conjunction with the accompanying drawings.

In this respect, before explaining the current embodiments of the bucket-mounted concrete tool-cleaning device in detail, it is to be understood that the bucket-mounted concrete tool-cleaning device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the bucket-mounted concrete tool-cleaning device.

It is therefore important that the claims be regarded as including such equivalent construction insofar as they do not depart from the spirit and scope of the bucket-mounted concrete tool-cleaning device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
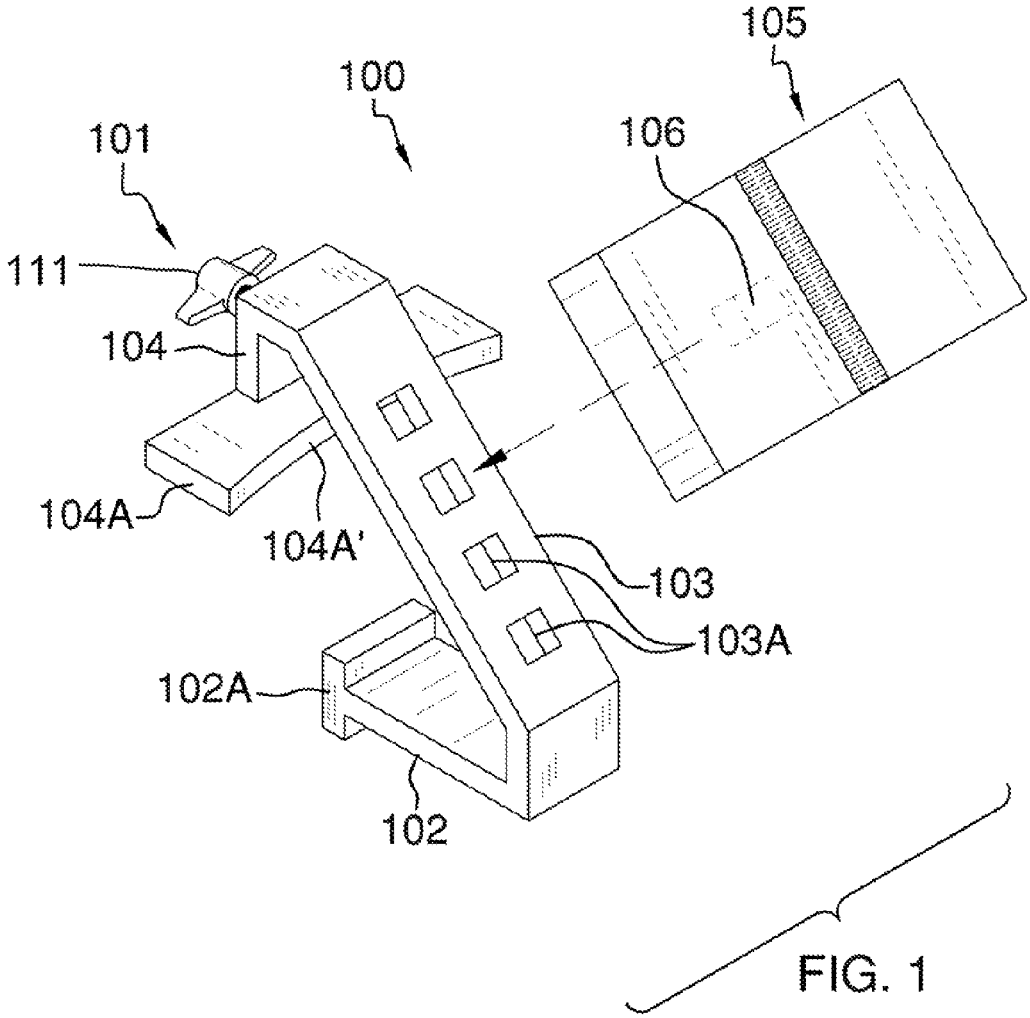
FIG. 1 illustrates an isometric view of the snap-on cleaner head and cleaner head base of the bucket-mounted concrete tool-cleaning device.
Figure 3:
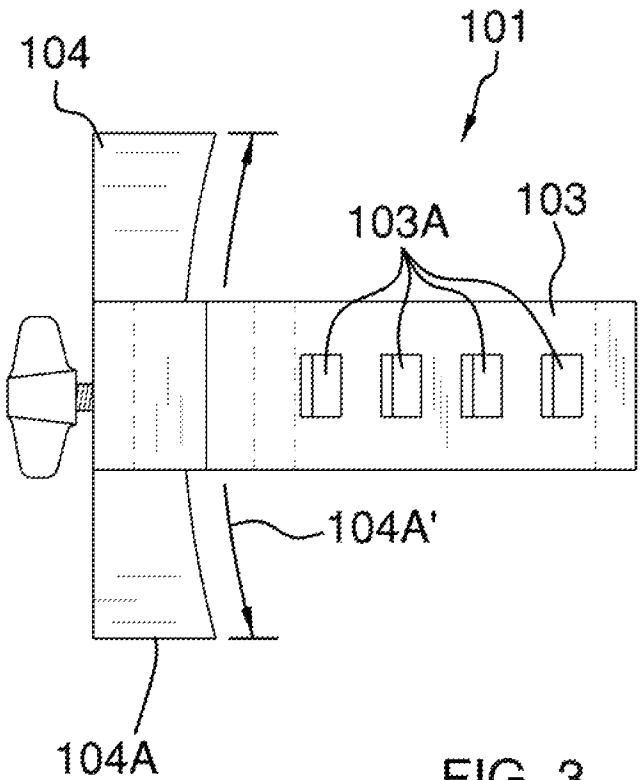
FIG. 3 illustrates a top view of the cleaner head base of the bucket-mounted concrete tool-cleaning device, and detailing the plurality of adjustment slots located on an outer surface of the cleaner head base.
Figure 2:
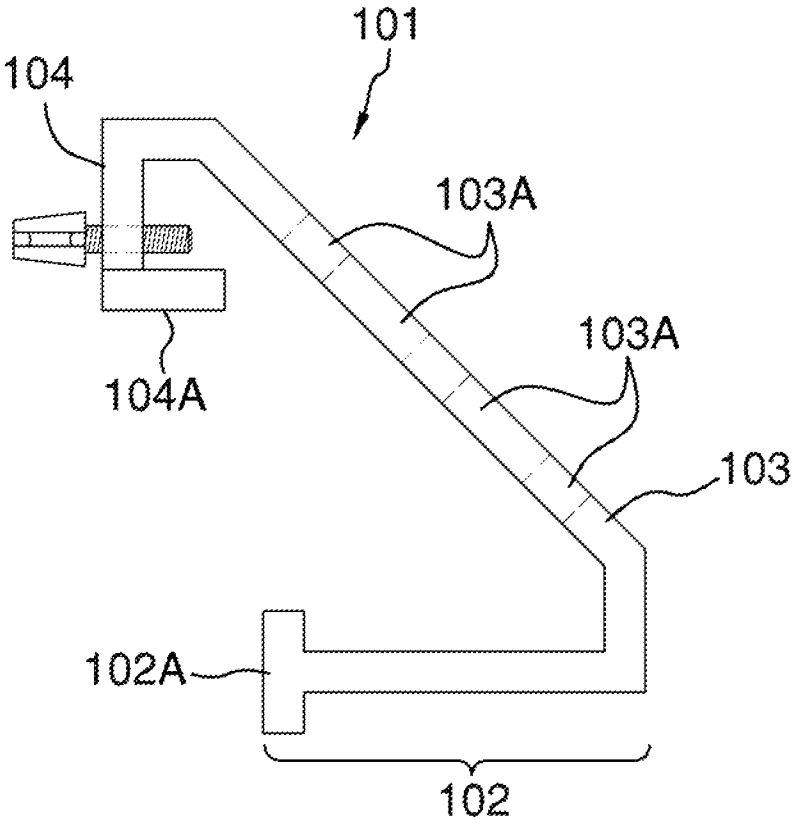
FIG. 2 illustrates a side view of the cleaner head base of the bucket-mounted concrete tool-cleaning device, and depicting the plurality of adjustment slots in dashed lines along the outer surface.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A bucket-mounted concrete tool-cleaning device 100 (hereinafter invention) includes a cleaner head base 101 that is defined by a base arm 102, an angled arm 103, and a top lip arm 104. The cleaner head base 101 forms an open triangular shape in which the top lip arm 104 engages a top lip 131 of a bucket 130. The top lip arm 104 features a lip 104A that slides underneath the top lip 131. The lip 104A may include a curved recess 104A', which accommodates the curvature of the bucket 130.

The base arm 102 is composed of a horizontally oriented section that abuts against an inner surface 132 of the bucket 130. The base arm 102 includes a base plate 102A that rests up against the inner surface 132 of the bucket 130.

The angled arm 103 forms an angle with respect to both the base arm 102 and the top lip arm 104. The angled arm 103 includes a plurality of slots 103A, which are equally spaced along the length of the angled arm 103.

At least one snap-on cleaner head 105 clips onto the angled arm 103. The snap-on cleaner heads 105 may include a clip 106 protruding from a rear surface of the snap-on cleaner head 105. The clip 106 enables the snap-on cleaner head 105 to attach to the angled arm 103 at one of the slots 103A. It shall be noted that the plurality of slots 103A provide height adjusting means to enable the respective snap-on cleaner head 105 to be placed at different elevations within the bucket 130, which is desirable when dealing with different water levels therein.

Figure 6A:
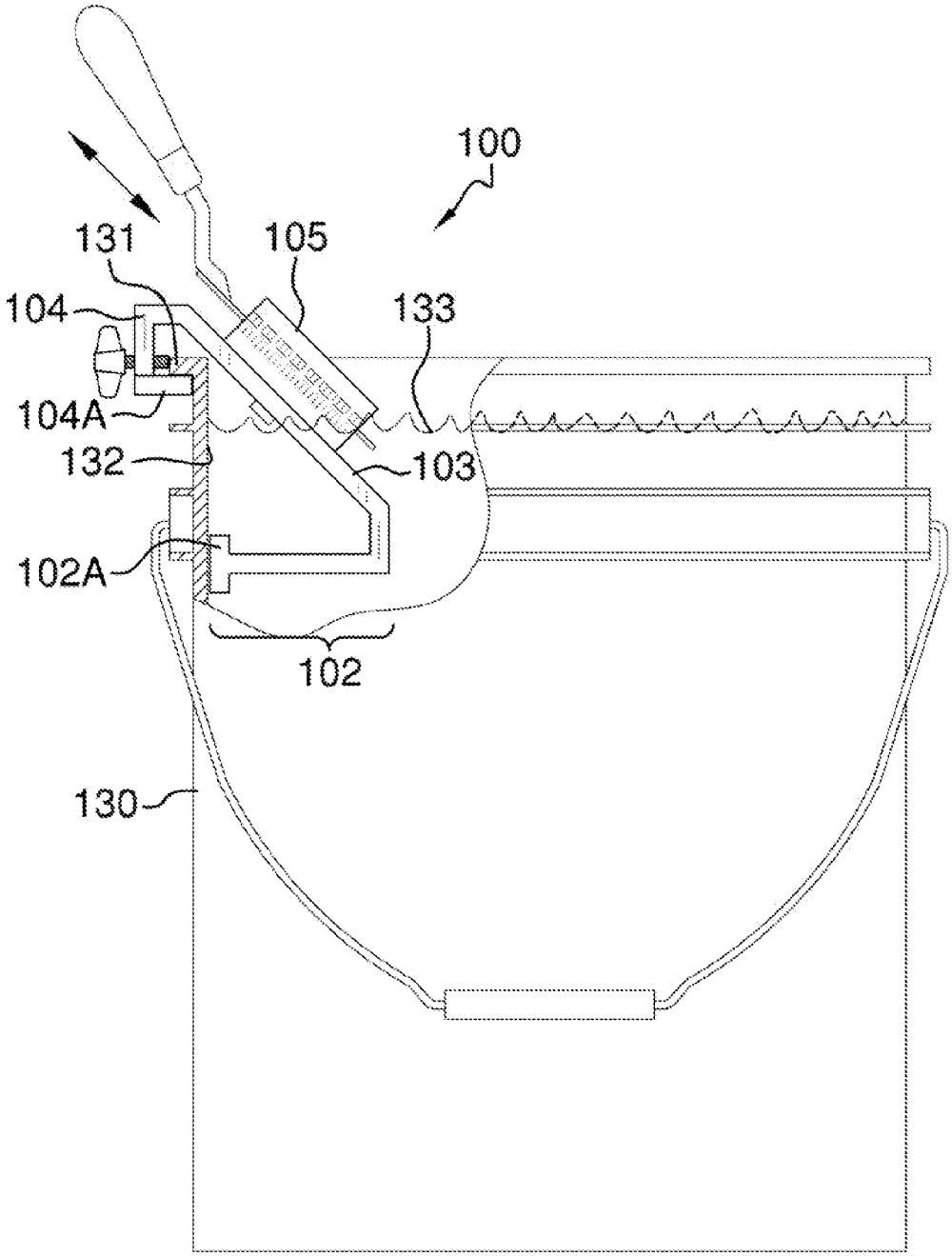
FIG. 6*a* and FIG. 6*b* illustrate a cut-away view of the bucket-mounted concrete tool-cleaning device installed on a bucket and with a hand trowel being inserted into the top snap on cleaner head.
Figure 6B:
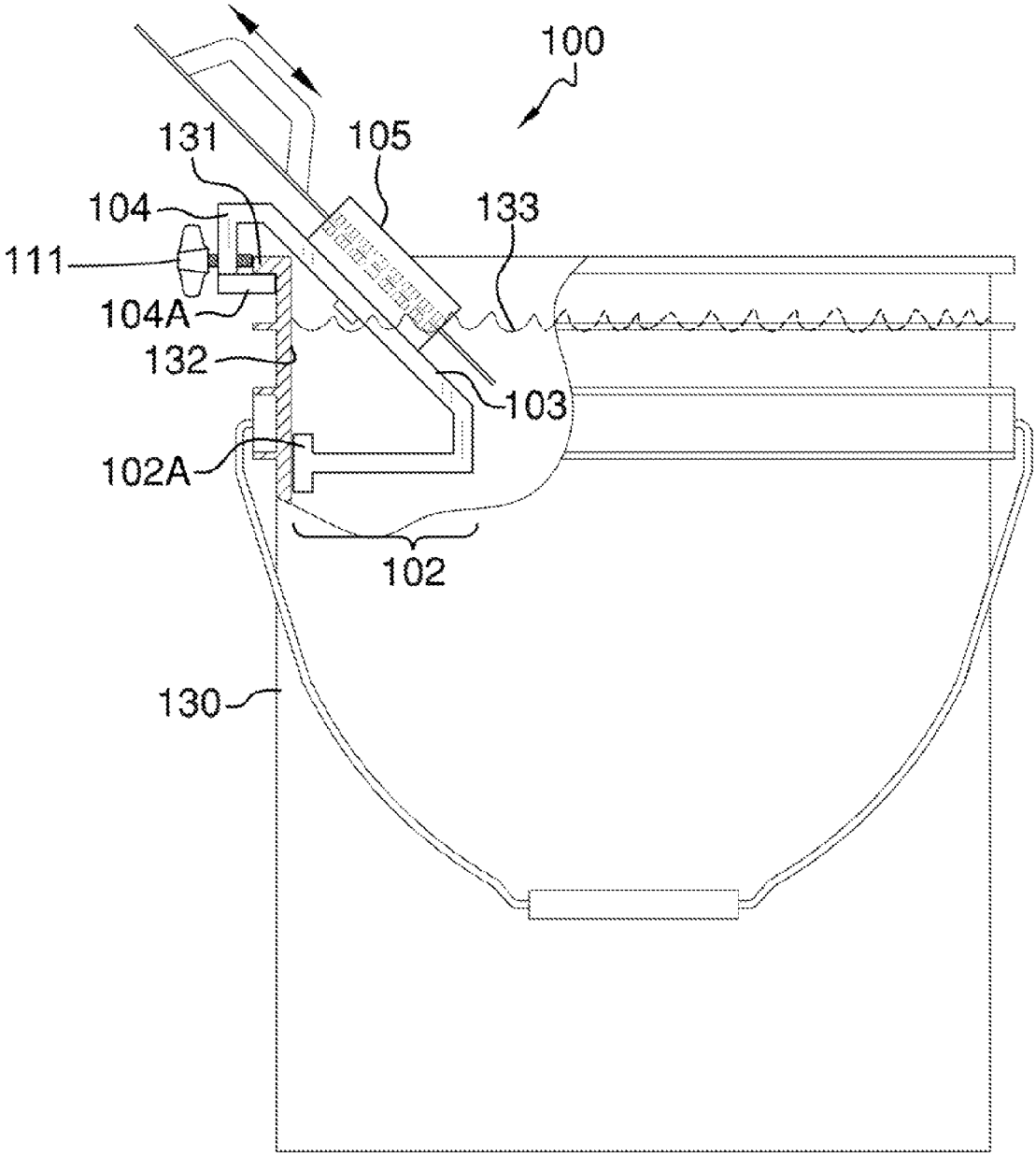

The angled arm 103 forms an angle with respect to the bucket 130 such that when inserting a concrete tool or float 140 (hereinafter tool) into water 133, residual concrete is washed therefrom (refer to FIGS. 6A and 6B). Moreover, the angled arm 103 forms an acute angle with respect to the bucket 130.

The snap-on cleaner heads 105 each include an open, inner channel 107. The snap-on cleaner heads 105 are designed to enable the tool to be slideably engaged within the open, inner channel 107. The open, inner channel 107 may include different cross-sections in order to accommodate tools or floats 140 of differing geometries. A plurality of bristles 108 adorn an inner surface 107A of the open, inner channel 107 such that upon insertion of the tool 140, residual concrete is scrubbed off. Thus, the invention 100 is designed to clean the tools 140 of residual concrete after use.

The open, inner channel 107 includes an opening 107B that enables a tool handle 141 to pass there through when engaging the tool 140 against the bristles 108.

Figure 4:
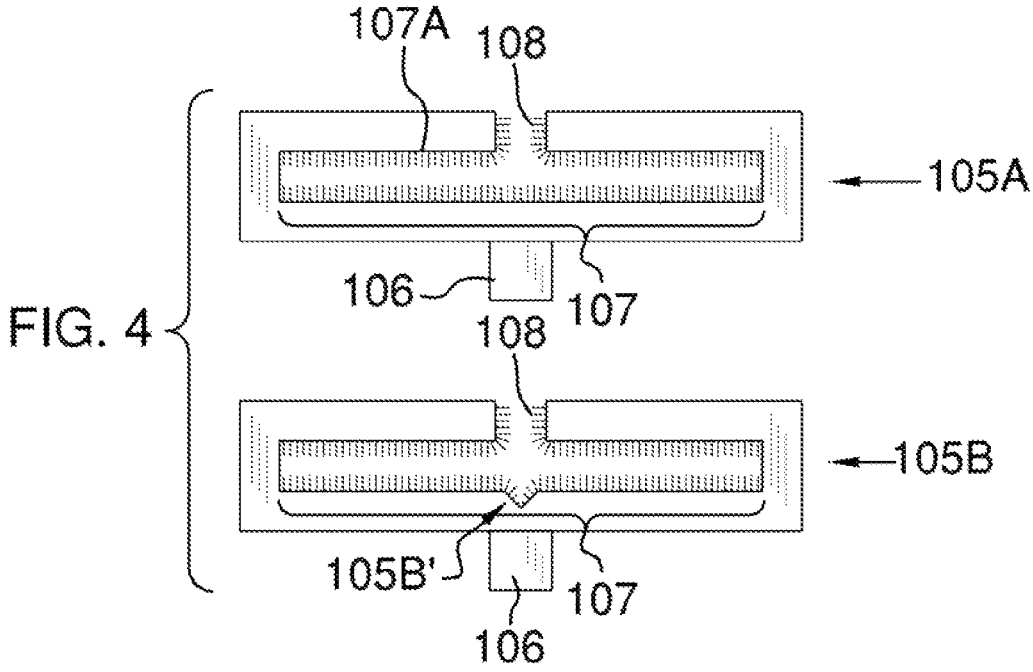
FIG. 4 illustrates a side view of the snap on cleaner head with depiction of the bristles.
Figure 5:
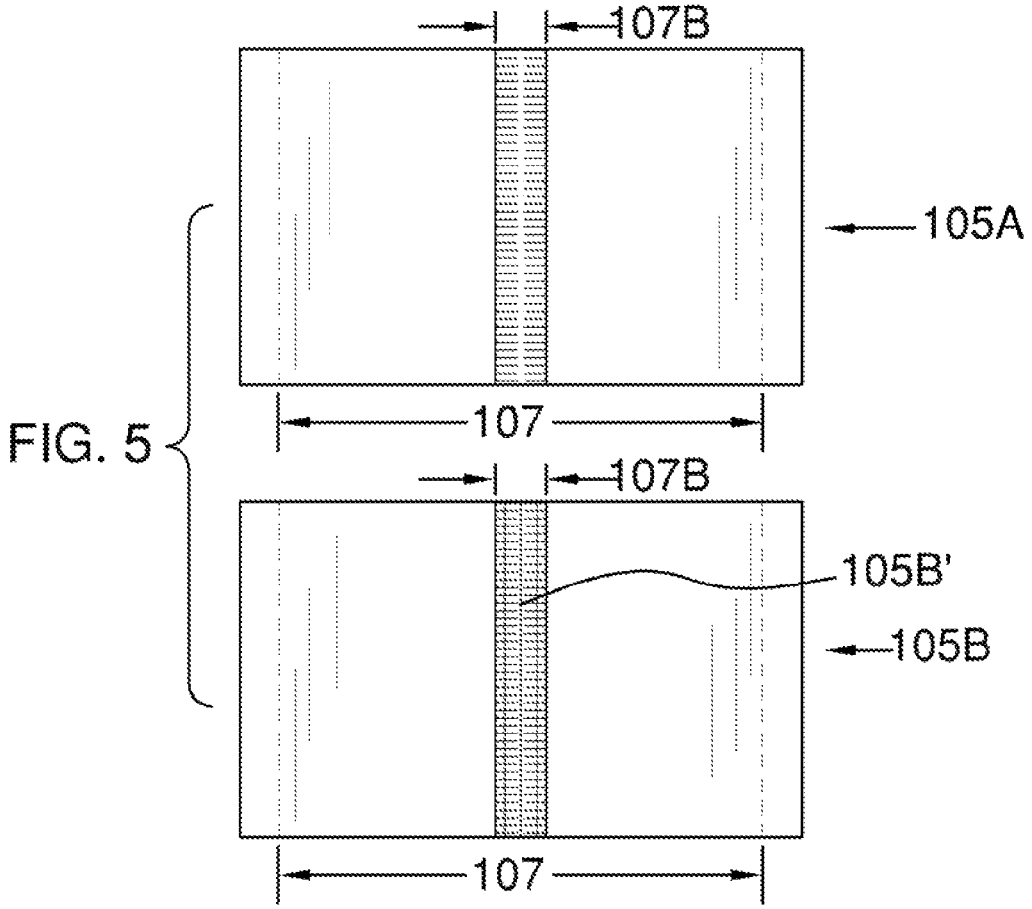
FIG. 5 illustrates a top view of two uniquely different snap on cleaner head wherein the top snap-on cleaner head is for use with floats and trowels whereas the bottom snap on cleaner head is for use with a jointer.

Referring to FIGS. 4 and 5, two different open, inner channels 107 are depicted, and reflect different cross-sections for different styled tools. A float/trowel cleaner head 105A depicts a flat rear, surface. A jointer cleaner head 105B depicts a small recess 105B', which is suited for cleaning off the jointer edge of jointer concrete tools that are well known in the art.

The cleaner head base 101 and the snap-on cleaner heads 105 may be made of a material comprising a plastic, wood, metal, carbon fiber composite, or ceramic.

The cleaner head base 101 includes a screw 111 that is threadably engaged with the cleaner head base 101 such that upon rotation of the screw 111, the screw 111 extends or retracts with respect to the cleaner head base 101. The screw 111 is included with the invention 100 in order to secure the cleaner head base 101 and the invention 100 onto the bucket 130.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The invention claimed is:

1. A bucket-mounted concrete tool-cleaning device, further comprising:

a cleaner head base that clips onto a bucket such that an angled arm is presented into an interior of said bucket at an acute angle and whereby at least one snap-on cleaner head attaches onto said angled arm and includes an open, inner channel adapted to receive a concrete tool or float to be cleaned and further including inwardly directed bristles for cleaning residual concrete from a concrete tool or float.

2. The bucket-mounted concrete tool-cleaning device as described in claim 1 wherein the cleaner head base is further defined by a base arm and a top lip arm both of which are attached to the angled arm.

3. The bucket-mounted concrete tool-cleaning device as described in claim 2 wherein the top lip arm features a lip that engages a top lip of said bucket.

4. The bucket-mounted concrete tool-cleaning device as described in claim 3 wherein a lip slides underneath the top lip of said bucket.

5. The bucket-mounted concrete tool-cleaning device as described in claim 4 wherein the lip includes a curved recess, which accommodates a curvature of the bucket.

6. The bucket-mounted concrete tool-cleaning device as described in claim 2 wherein the base arm is composed of a horizontally oriented section that abuts against an inner surface of the bucket.

7. The bucket-mounted concrete tool-cleaning device as described in claim 6 wherein the base arm includes a base plate that rests up against the inner surface of the bucket.

8. The bucket-mounted concrete tool-cleaning device as described in claim 1 wherein the angled arm includes a plurality of slots, which are equally spaced along the length of the angled arm.

9. The bucket-mounted concrete tool-cleaning device as described in claim 8 wherein the snap-on cleaner head includes a clip protruding from a rear surface of the snap-on cleaner head, which enables the snap-on cleaner head to attach to the angled arm at one of the slots.

10. The bucket-mounted concrete tool-cleaning device as described in claim 1 wherein the plurality of bristles adorn an inner surface of the open, inner channel such that upon insertion of the tool or float, residual concrete is scrubbed off; wherein the open, inner channel includes an opening that enables a tool handle to pass there through when engaging the tool against the bristles.

11. The bucket-mounted concrete tool-cleaning device as described in claim 1 where in the cleaner head base includes a screw that is threadably engaged therewith and which extends and retracts laterally thereto; wherein the screw is rotated to tighten and lock the cleaner head base to the bucket.

12. A bucket-mounted concrete tool-cleaning device, further comprising:

a cleaner head base that clips onto a bucket such that an angled arm is presented into an interior of said bucket at an angle and whereby at least one snap-on cleaner head attaches onto said angled arm and includes an open, inner channel adapted to receive a concrete tool or float to be cleaned and further including inwardly directed bristles for cleaning residual concrete from a concrete tool or float;

wherein the cleaner head base is further defined by a base arm and a top lip arm both of which are attached to the angled arm;

wherein the top lip arm features a lip that engages a top lip of said bucket;

wherein a lip slides underneath the top lip of said bucket;

wherein the base arm is composed of a horizontally oriented section that abuts against an inner surface of the bucket;

wherein the base arm includes a base plate that rests up against the inner surface of the bucket.

13. The bucket-mounted concrete tool-cleaning device as described in claim 12 wherein the lip includes a curved recess, which accommodates a curvature of the bucket.

14. The bucket-mounted concrete tool-cleaning device as described in claim 12 wherein the angled arm includes a plurality of slots, which are equally spaced along the length of the angled arm.

15. The bucket-mounted concrete tool-cleaning device as described in claim 14 wherein the snap-on cleaner head includes a clip protruding from a rear surface of the snap-on cleaner head, which enables the snap-on cleaner head to attach to the angled arm at one of the slots.

16. The bucket-mounted concrete tool-cleaning device as described in claim 12 wherein the plurality of bristles adorn an inner surface of the open, inner channel such that upon insertion of the tool or float, residual concrete is scrubbed off; wherein the open, inner channel includes an opening that enables a tool handle to pass there through when engaging the tool against the bristles.

17. The bucket-mounted concrete tool-cleaning device as described in claim 16 wherein the open, inner channel may include a small recess, which is suited for cleaning off a jointer edge of jointer concrete tools.

18. The bucket-mounted concrete tool-cleaning device as described in claim 12 wherein the cleaner head base includes a screw that is threadably engaged therewith and which extends and retracts laterally thereto; wherein the screw is rotated to tighten and lock the cleaner head base to the bucket.

* * * * *